US005098550A

United States Patent [19]

Mueller et al.

[11] Patent Number: 5,098,550

[45] Date of Patent: Mar. 24, 1992

[54] METHOD FOR DEWAXING WAXY PETROLEUM PRODUCTS

[75] Inventors: Michael Mueller, Bensheim; Horst Pennewiss, Darmstadt, both of Fed. Rep. of Germany

[73] Assignee: Röhm GmbH, Darmstadt, Fed. Rep. of Germany

[21] Appl. No.: 592,703

[22] Filed: Oct. 3, 1990

[30] Foreign Application Priority Data

Oct. 6, 1989 [DE] Fed. Rep. of Germany ..... 3933376

[51] Int. Cl.[5] ..... C10G 73/04

[52] U.S. Cl. ..... 208/37; 208/35; 208/33; 208/38

[58] Field of Search ..... 208/33, 35, 37; 44/397

[56] References Cited

U.S. PATENT DOCUMENTS

| | | | |
|---|---|---|---|
| 2,642,414 | 6/1953 | Bauer et al. | 44/397 |
| 2,891,991 | 6/1959 | Stewart | 44/397 |
| 3,458,430 | 7/1969 | Henselman et al. | 208/35 |
| 3,479,278 | 11/1969 | DeVault | 208/33 |
| 3,773,650 | 11/1973 | Hislop et al. | 208/33 |
| 4,191,631 | 3/1980 | Grisham, Jr. | 208/33 |
| 4,406,771 | 9/1983 | Briens et al. | 208/33 |
| 4,422,924 | 12/1983 | Onodera et al. | 208/33 |
| 4,451,353 | 5/1984 | Briens et al. | 208/33 |
| 4,460,453 | 7/1984 | Gudelis et al. | 208/33 |
| 4,461,698 | 7/1984 | Briens et al. | 208/33 |
| 4,541,917 | 9/1985 | West | 208/33 |
| 4,564,438 | 1/1986 | Wang et al. | 208/33 |
| 4,594,142 | 6/1986 | Achia et al. | 208/33 |
| 4,608,151 | 8/1986 | Muller | 208/33 |
| 4,695,363 | 9/1987 | West | 208/33 |
| 4,728,414 | 3/1988 | West et al. | 208/33 |
| 4,956,492 | 9/1990 | Dekraker et al. | 208/33 |

*Primary Examiner*—Helane E. Myers
*Attorney, Agent, or Firm*—Donald R. Bentz

[57] ABSTRACT

A method for the solvent dewaxing of wax-containing petroleum products with at least one solvent suitable for dewaxing and a polymeric dewaxing aid comprising polyacrylates, by mixing the products to be dewaxed with the solvent and the polymeric dewaxing aid, chilling the mixture so obtained, and separating the precipitated wax, the dewaxing aid used being a mixture of (I) a polymer of esters of acrylic acid with $C_{10}$–$C_{40}$ alkanols and (II) a polymer of esters of methacrylic acid with alkanols comprising more than 10 weight percent of branched alkanols, the weight ratio between components (I) and (II) ranging from 1:20 to 20:1.

7 Claims, No Drawings

METHOD FOR DEWAXING WAXY PETROLEUM PRODUCTS

The present invention relates to a method for dewaxing, and particularly for solvent dewaxing, petroleum products containing wax by the use of dewaxing aids comprising a polyacrylate.

THE PRIOR ART

The occurrence of paraffin waxes in petroleum and in petroleum products renders their handling much more difficult, mainly because of the tendency of the waxes to crystallize below a certain temperature, which differs from case to case. (See, for example, *Ullmanns Enzyklopadie der technischen Chemie,* 4th ed., vol. 20, pp. 548 ff, Verlag Chemie, 1981.) The wax can be extracted from lighter petroleum fractions simply by chilling the fractions to the crystallization temperature of the wax and filtering them through filter presses.

The most widely used commercial process for the dewaxing of waxy petroleum oils employs solvents, mainly low-boiling aliphatic hydrocarbons such as pentane, hexane, heptane, octane, etc.; ketones such as acetone, methylethyl ketone, methylisobutyl ketone, etc.; aromatic hydrocarbons such as benzene, toluene, xylene, etc.; and mixtures of solvents. Here, too, the wax-containing oil which has been mixed with the solvent is chilled until the wax precipitates in the form of fine particles. The precipitated wax particles are charged to a wax separator, that is a filtering system, and thus separated from the oil and the solvents used to remove the wax.

In the actual operation of the process, difficulties are posed by the filter throughput capacity, which is far from constant and which is determined by the crystal structure of the wax to be separated, among other factors. The crystal structure is influenced by various factors during operation, but primarily by the chilling conditions. The nature of the waxes and the size and habit of their crystals give rise to a relatively wide range of variation with respect to the texture and permeability of the filter cake, which of course calls for adjustment of the conditions of filtration. What is dreaded is the formation of very fine wax crystallites, which are very difficult to filter, with some of them migrating through the filters to create a haze in the oil. To improve filtration in general and the filtration rate and the oil yield in particular, dewaxing aids have been developed which are added to the oils during the dewaxing operation.

These dewaxing aids are usually polymers, for example, of the type of the alpha-olefin copolymers (OCP), ethylene-vinyl acetate (EVA) copolymers and polyalkyl acrylates and methacrylates of $C_2$–$C_{20}$ alcohols. U. S. Pat. No. 4,451,353 proposes a dewaxing process in which waxy oil distillates are mixed with a dewaxing solvent and a dewaxing aid comprising a polyacrylate, the mixture is chilled to form a thin slurry of solid wax particles, and the wax and the liquid constituents formed by the dewaxed oil and the solvent are separated by filtration. The dewaxing aid is composed of (A) a polyacrylate and (B) an n-alkyl methacrylate polymer, the components (A) and (B) being used in a weight ratio from 1:100 to 100:1.

The claims and specification of the aforesaid U.S. patent make it clear beyond a doubt that the methacrylate component is to consist of esters of substantially linear, that is unbranched, alcohols having from 10 to 20 carbon atoms. Those skilled in the art therefore had to assume that this group of methacrylic esters was particularly well suited for use as dewaxing aids. While the prevailing hypotheses concerning the mechanism of action of such polymeric dewaxing aids attempt to provide plausible explanations for the influence of the polymeric additive on the crystallization behavior of the waxes, they offer no rules for the selection of specific polymer compositions. (See, for example, *Ullmanns Enzyklopadie, loc. cit.*, vol. 20.) Thus, there has been a continuing need for more effective dewaxing aids, preferably based on starting materials known per se, that require no substantial changes in the practice of dewaxing petroleum and petroleum products.

In the light of the results obtained so far, the method of the present invention goes a long way toward meeting that need.

The invention thus relates to a method for the solvent dewaxing of petroleum products containing wax, particularly of petroleum oil distillates, by the use of at least one solvent suitable for dewaxing and of a polymeric dewaxing aid comprising a polyacrylate, the products to be dewaxed being mixed with the solvent and the polymeric dewaxing aid, the mixture obtained being chilled, and the precipitated wax being separated, which method is characterized in that the dewaxing aid used is a polymer mixture of (I) a polymer, Pl, of esters of acrylic acid with $C_{10}$–$C_{40}$ alkanols and (II) a polymer, P2, of esters of methacrylic acid with alkanols comprising more than 10 weight percent of branched alkanols, the weight ratio between components (I) and (II) in said polymer mixture ranging from 1:20 to 20:1, and preferably from 1:10 to 10:1. As a rule, the polymers Pl and P2 are added in an amount of from 0.01 to 1 weight percent, based on the wax-containing petroleum stocks.

This process advantageously adds directly onto the prior art, for example as outlined in U. S. patent 4,451,353.

With regard to the petroleum stocks which are amenable to dewaxing, the method does not appear to have any definite limitations. From a practical point of view, however, it is particularly well suited for waxy distillate oils, especially those with a boiling range from about 300° C. to about 600° C., a density of about 0.08 to 0.09 g/cc at 15° C., a viscosity of about 10 to 20 cSt/100° C., a pour point of about 30° C. to 50° C., and a dry wax content of about 10 to about 25 weight percent. Most desirable are distillate oil fractions which include lubricating oils and specialty oils boiling within the range of 300° C. to 600° C., and preferably those with a mid-boiling point of about 400° C. to 450° C.

The solvents used for solvent dewaxing according to the invention are also those commonly used. (See "The prior art".) Illustrative of these are aliphatic hydrocarbons having a boiling point of less than 150° C., including such autorefrigerative gases as propane, propylene, butane, and pentane, as well as isooctane and the like; aromatic hydrocarbons such as toluene and xylene; ketones such as acetone, dimethylketone, methylethyl ketone, methylpropyl ketone, and methylisobutyl ketone; and optionally also halogenated hydrocarbons such as methylene chloride and dichloroethane; or N-alkylpyrrolidones such as N-methylpyrrolidone and N-ethylpyrrolidone.

Mixtures of solvents, for example mixtures of ketones and aromatic hydrocarbons, such as methylethyl ketone/toluene or methylisobutyl ketone/toluene, are also advantageous.

In the method of the invention, the solvents are added in the usual amounts, for example from 0.5 to 10 parts by volume, and preferably from 2 to 7 parts by volume, based on the petroleum stock to be dewaxed.

The polymers P1 and P2

The starting monomers for the polymerization of P1 and P2 (which are already being used industrially in the production of polyalkyl acrylates and polyalkyl methacrylates) are known per se. The polymerization of these monomers can also be carried out in a manner known per se.

The polyalkyl acrylates P1 are built up from acrylic esters of $C_{10}$–$C_{40}$ alkanols, and more particularly from acrylic esters of $C_{18}$–$C_{24}$ alkanols, for example of the behenyl alcohol type. The molecular weight advantageously ranges from 10,000 to 1,500,000, and preferably from 50,000 to 500,000. Molecular weight may suitably be determined by gel permeation chromatography. See, for example, Kirk-Othmer, *Encyclopedia of Chemical Technology*, 3rd ed., vol. 18, pp. 209 and 749, John Wiley & Sons, 1982.)

A characteristic of the polyalkyl methacrylates P2 is that they contain more than 10, and preferably more than 15, percent by weight of esters of methacrylic acid having branched alkyl groups. As a rule, the polymers P2 are esters of $C_1$–$C_{40}$ alkanols, preferably $C_1$–$C_{26}$ alkanols, and more particularly esters of $C_{10}$–$C_{24}$, and preferably of $C_{12}$–$C_{18}$, alkanols. The polymer P2 may contain from 0.1 to 20, and more particularly from 1 to 15, percent by weight of $C_1$–$C_9$ alkyl methacrylates. Examples are alkanols with $C_{12}$–$C_{18}$ hydrocarbon groups, for example having an average of 14 carbons, such as mixtures of "Dobanol 25L" (a product of Shell AG) and tallow fatty alcohol, as well as mixtures of tallow fatty alcohol and other alcohols, for example isodecyl alcohol.

The molecular weight (see above) will generally range from 3000 to 500,000 and preferably ranges from 50,000 to 300,000.

The free radical polymerization is advantageously carried out in a solvent that is compatible with the petroleum stock to be dewaxed, for example in a petroleum base oil. Commonly used polymerization initiators, for example peroxy compounds, and particularly peresters such as tert.-butyl peroxypivalate, tert.-butyl peroctoate, tert.-butyl perbenzoate, and the like, are employed in the usual amounts, for example from 0.1 to 5, and preferably from 0.3 to 1, percent by weight of the monomers. (See, for example, Th. Völker and H. Rauch-Puntigam, *Acryl- und Methacrylverbindungen*, Springer-Verlag, 1967.)

Molecular weight regulators, and more particularly organosulfur chain transfer agents, and specifically mercaptans such as dodecyl mercaptans, may be added to the mixtures in the usual amounts, for example, from 0.01 to 2 percent by weight of the monomers.

The operation is advantageously performed under an inert gas such as carbon dioxide.

The monomers are advantageously dissolved in the solvent, optionally together with the molecular weight regulator and the initiator, in a suitable polymerization vessel equipped with a stirrer, degassed with dry ice ($CO_2$) for example, and then heated. A temperature of 80° C.±10° C., for example, will serve as a guide. In individual cases, the initiator may also be added to the heated mixture. If desired, more monomer and initiator as well as molecular weight regulator may be metered in. As a rule, the temperature will continue to rise, for example, to 140° C.±10° C. Optionally, suitable conditions for continued polymerization may be established through heat input and/or by adding more initiator. The total polymerization time generally is less than 12 hours.

The polymer components P1 and P2 may advantageously be used as separately produced preparations. They are then admixed in the aforesaid weight ratios and in the intended proportions with the petroleum stocks to be dewaxed, either as such or in a compatible solvent such as wax free petroleum oil or one of the dewaxing solvents or solvent mixtures, care being taken to exceed the cloud point of the oils to be dewaxed, for example by heating to 50° C.–120° C. The polymers P1 and P2 may be added together or separately. They may be added before chilling or during chilling, but in the latter case in prechilled solvents. Chilling may be carried out as in U.S. Pat. No. 3,773,650, for example. The mixture of polymers P1 and P2, along with the dewaxing solvent, is advantageously introduced in a chilling zone and at a temperature which is adjusted to the pour point of the resulting dewaxed oil.

The chilling step results in the formation of a very fluid slurry comprising dewaxed oil and solvent along with solid wax particles. As a rule, the wax particles contain polymers P1 and P2. The temperature used in chilling depends on the nature of the petroleum stock to be dewaxed and on the entire operating procedure. Dewaxing is generally carried out at temperatures ranging from 0° C. to −50° C. When a solvent mixture of a ketone and an aromatic hydrocarbon is employed, the dewaxing temperature should be between −10° C. and −30° C.

Special effects

The results obtained with mixtures of the polymers P1 and P2 show, quite unexpectedly, that the use of polyalkyl methacrylate components with moderately high degrees of branching of the alkyl groups results in significantly greater effectiveness and more pronounced synergistic effects than when substantially linear polyalkyl acrylates or methacrylates are used. These findings are based on widely differing dewaxing solvents and paraffinic petroleum feedstocks, as evidenced by the examples which follow, and it can therefore be assumed that they have general validity.

A better understanding of the present invention and of its many advantages will be had by referring to the following specific example, given by way of illustration.

In the example, specific viscosity was determined in conformity with DIN 7745 in chloroform as solvent at 20° C.

EXAMPLES

(A) Production of Polymers P1 AND P2

Example 1—Production of a polybehenyl acrylate P1

51 kg of behenyl acrylate ($C_{18}$–$C_{24}$ acrylate), 9 kg of 100N oil, and 0.051 kg of dodecyl mercaptan were introduced as an initial charge into a 100 liter stirred kettle, degassed with dry ice ($CO_2$), and heated to 70° C. Then 0.191 kg of tert-butyl perpivalate and 0.115 kg of tert.-butyl perbenzoate were added to initiate the polymerization. One hour after reaching a peak temperature of 134° C., the batch was mixed with 0.077 kg of dodecyl mercaptan and 0.051 kg of tert.-butyl perbenzoate and the polymerization was continued for 3 hours at 130° C.

Weight average molecular weight (GPC, PMMA calibration): 560,000 g/mol.

Specific viscosity ($CHCl_3$, 20° C.): 48 ml/g.

Example 2—Production of poly $C_{12}$–$C_{18}$ alkylmethacrylate P2—1

2.967 kg of a $C_{12}$–$C_{18}$ alkyl methacrylate (average number of carbons = 14; 17.9% branched; comprising a mixture of "Dobanol L25" of Shell AG and tallow fatty alcohol, for example), 26.7 kg of 100N oil, and 0.083 kg of tert.-butyl peroctoate were introduced as an initial charge into a 150 liter stirred kettle, degassed with dry ice ($CO_2$), and heated to 85° C. Over a period of 3½ hours, 37.033 kg of $C_{12}$–$C_{18}$ alkylmethacrylate and 0.0741 kg of tert.-butyl peroctoate were then metered in. Two hours after the end of this addition another 0.08 kg of tert.-butyl peroctoate was fed in. After another 5 hours, the batch was diluted with 33.3 kg of 100N oil.

Weight average molecular weight (GPC, PMMA calibration): 410,000 g/mol.

Specific viscosity ($CHCl_3$, 20° C.): 65 ml/g.

Amount of branched ester: 17.9 percent by weight.

Examples 3 to 5 —Production of poly($C_{12}$–$C_{18}$)alkyl methacrylates having different degrees of branching of the alkyl groups The same procedure was followed as in Example 2, except that other alcohol mixtures were used in place of "Dobanol" and tallow fatty alcohol. The properties of the polymers are summarized in the following table:

| Example | Carbons in alkyl groups | Proportion of branched ester, wt. % | Specific viscosity ($CHCl_3$, 20° C.) | |
|---|---|---|---|---|
| 3 | 13–18 | 27.2 | 62 | P2-2 |
| 4 | 13–18 | 38.9 | 64 | P2-3 |
| 5 | 12–18 | 46.7 | 63 | P2-4 |
| Comparative example | 12–18 | 0 | 61 | V2-1 |

Example 6—Production of a copolymer of iso—$C_{10}$—methacrylate and tallow fatty methacrylate P2–5

37 kg of 100N oil and 4.111 kg of a methacrylic ester of an alcohol mixture comprising 57.9 percent by weight of tallow fatty alcohol (average C value = 17) and 42.1 percent by weight of isodecyl alcohol were introduced as initial charge into a 100 liter stirred kettle and heated to 85° C.. The batch was then degassed by adding dry ice ($CO_2$), and 0.016 kg of dodecyl mercaptan and 0.032 kg of tert.-butyl peroctoate were added. Over a period of 3½ hours, another 58.889 kg of the methacrylic ester, 0.236 kg of dodecyl mercaptan, and 0.177 kg of tert.-butyl peroctoate were metered in. Two hours after the end of this addition, another 0.126 kg of tert.-butyl peroctoate was fed in. After another 5 hours, the polymerization was completed.

Specific viscosity ($CHCl_3$, 20° C.): 22 ml/g.

Amount of branched esters: 45.2 percent by weight.

Example 7—Production of poly $C_1$–$C_{18}$ alkylmethacrylate P2–6

1.976 kg of a $C_{12}$–$C_{18}$ alkyl methacrylate (average number of carbons = 14; 17.9% branched; comprising a mixture of "Dobanol L25" of Shell AG. and tallow fatty alcohol, for example), and 0.0297 kg of methyl methacrylate, 17.8 kg of 100N oil, and 0.0551 kg of tert.-butyl peroctoate were introduced as an initial charge into a 100 liter stirred kettle, degassed with dry ice ($CO_2$), and heated to 85° C.. Over a period of 3½ hours, 24.664 kg of $C_{12}$–$C_{18}$ alkylmethacrylate, 6.223 kg of methyl methacrylate and 0.0494 kg of tert.-butyl peroctoate were then metered in. Two hours after the end of this addition, another 0.053 kg of tert.-butyl peroctoate was fed in. After another 5 hours, the batch was diluted with 22.18 kg of 100N oil.

Specific viscosity ($CHCl_3$, 20° C.): 34 ml/g.

Amount of branched ester: 14.5 percent by weight.

Comparative Example 2—Production of an unbranched poly ($C_{16}$–$C_{18}$) alkyl methacrylate V2-2

4.889 kg of a $C_{16}$–$C_{18}$ alkylmethacrylate (based, for example, on "Alfol 1618 S", an alcohol manufactured by Condea), 44.0 kg of 100N oil, and 0.172 kg of tert.-butyl peroctoate were introduced as initial charge into a 150 liter stirred kettle. After degassing with dry ice ($CO_2$), the batch was heated to 85° C.. Over a period of 3½ hours, 51.111 kg of a $C_{16}$–$C_{18}$ alkylmethacrylate and 0.153 kg of tert.-butyl peroctoate were then added with a metering pump. Two hours after the end of this addition, another 0.112 kg of tert.-butyl peroctoate was fed in. After another 5 hours, the polymerization was completed.

Weight average molecular weight (GPC, PMMA calibration): 220,000 g/mol.

Specific viscosity ($CHCl_3$, 20° C.: 44 ml/g.

Amount of branched ester: 0 percent by weight.

Performance of a Laboratory Filtration Test For Determination of Oil Yield and Filtration Rate Examples 8–10—Dewaxing of various feedstocks The filtration apparatus consists of a steel filter having a cover and a cooling jacket which is cooled by circulation with the aid of a cryostat. Filter cloth from the dewaxing plant of the refinery concerned is used. The filter volume is 100 ml. The filter is connected with a graduated measuring cylinder by way of a glass attachment having a two-way stopcock. By means of a rotary sliding-vane oil pump, a pressure reducing valve, and a manometer, a given vacuum can be applied to the filtration apparatus. The petroleum oil distillate to be dewaxed is mixed with the dewaxing solvents at a temperature above the cloud point and stirred until clear solution is obtained. The latter is cooled at a given rate to the desired filtration temperature with the aid of a cryostat having a temperature control. The filter is precooled to that temperature.

All filtration conditions, such as solvent/feedstock ratio, ratio of solvents in the case of mixtures, cooling rates, and filtration temperature correspond to the conditions employed in the refinery concerned. Since working with propane poses a problem in the laboratory, isooctane has been used in place of propane.

Once the filtration temperature has been reached, the mixture is transferred to the precooled filter and a vacuum is applied. The volume of filtrate is measured as a function of time and the filtration rate F is determined as the gradient of the linear plot of $V/2S^2$ against t/V, V being the filtrate volume, t the time in seconds, and S the filter area in square centimeters.

After the solvents have been distilled off using rotary evaporator, optionally azeotropically with the aid of a further solvent, the dewaxed oil obtained is dried to constant weight and the oil yield is determined gravimetrically. The oil content of the wax filtered off is determined in conformity with ISO 2908.

Example 8
Dewaxing of Heavy Neutral 95 from a Spanish Refinery
Solvent: Isooctane. Weight ratio of feedstock to solvent: 1:4. Chilling from +60° C. to +5° C. was accomplished by immersion in a 0° C. refrigerant bath, and chilling from +5° C. to −20° C. by immersion in a −22° C. refrigerant bath, both with stirring. Stirring was then continued for another 20 minutes and followed by filtration.

| Dewaxing additives | | | | Dewaxing | | |
|---|---|---|---|---|---|---|
| Polyalkyl acrylate | Polyalkyl meth-acrylate | Percent branched | Mix-ing ratio | Filter-ability ($cm^2/s$) | Fil-tration time (sec) | Oil yield (%) |
| — | — | — | — | $1.1 \times 10^{-2}$ | 2460 | 73.7 |
| P1 | — | — | — | $9 \times 10^{-2}$ | 300 | 83.0 |
| P1 | P2-1 | 17.9 | 1:1 | $26 \times 10^{-2}$ | 90 | 83.9 |
| P1 | P2-1 | 17.9 | 2:1 | $47 \times 10^{-2}$ | 70 | 85.4 |
| P1 | P2-2 | 27.2 | 1:1 | $48 \times 10^{-2}$ | 60 | 84.6 |
| P1 | P2-3 | 38.9 | 1:1 | $70 \times 10^{-2}$ | 40 | 84.7 |
| P1 | V2-1 | — | 1:1 | $18 \times 10^{-2}$ | 150 | 83.7 |

Example 9
Dewaxing of Bright Stock 95 from a Spanish Refinery
Solvent: Isooctane.
Conditions of laboratory experiments as described in Example 8.

| Dewaxing additives | | | | Dewaxing | | |
|---|---|---|---|---|---|---|
| Poly-alkyl acry-late | Polyalkyl meth-acrylate | Percent branched | Mix-ing ratio | Filter-ability ($cm^2/s$) | Fil-tration time (sec) | Oil yield (%) |
| — | — | — | — | $0.09 \times 10^{-2}$ | 3300 | 83 |
| P1 | — | — | — | $14 \times 10^{-2}$ | 180 | 83.4 |
| — | P2-1 | 17.9 | — | $4 \times 10^{-2}$ | 480 | 82.8 |
| P1 | P2-1 | 17.9 | 1:1 | $24 \times 10^{-2}$ | 90 | 83.2 |
| P1 | P2-1 | 17.9 | 3:1 | $25 \times 10^{-2}$ | 120 | 83.2 |
| P1 | P2-1 | 17.9 | 5:1 | $28 \times 10^{-2}$ | 90 | 83.4 |
| P1 | P2-1 | 17.9 | 10:1 | $23 \times 10^{-2}$ | 120 | 83.3 |
| P1 | P2-2 | 27.2 | 1:1 | $28 \times 10^{-2}$ | 90 | 82.8 |
| P1 | P2-3 | 38.9 | 1:1 | $23 \times 10^{-2}$ | 90 | 82.6 |
| P1 | P2-6 | 14.5 | 1:1 | $22 \times 10^{-2}$ | 100 | 83.3 |
| — | V2-2 | 0 | — | $4 \times 10^{-2}$ | 420 | 82.9 |
| P1 | V2-2 | 0 | 1:1 | $14 \times 10^{-2}$ | 180 | 82.8 |
| P1 | V2-1 | 0 | 1:1 | $22 \times 10^{-2}$ | 140 | 82.8 |

Example 10
Dewaxing of a 500N Feedstock from a German Refinery
Solvent: Mixture of ethyl methyl ketone and toluene, volume ratio 1:1. Ratio of feedstock to solvent: 1:3. Chilling from +70° C. to −17° C. at the rate of 3.5° C. per minute. Filtration at −17° C.

| Dewaxing additives | | | | | Dewaxing | | | |
|---|---|---|---|---|---|---|---|---|
| Poly-acrylate | Polymeth-acrylate | Percent branched | Mixing ratio | Dosage | Filter-ability ($cm^2/s$) | Filtration time (sec) | Oil yield (%) | Oil content of wax (%) |
| — | — | — | — | — | $1.5 \times 10^{-2}$ | 1100 | 42.4 | 63.4 |
| P1 | — | — | — | 250 | $3.6 \times 10^{-2}$ | 420 | 57.3 | — |
| | | | | 500 | $3.6 \times 10^{-2}$ | 480 | 57.4 | 58 |
| | P2-1 | 17.9 | — | 250 | $1.8 \times 10^{-2}$ | 840 | 43.2 | — |
| | | | | 500 | $1.4 \times 10^{-2}$ | 1260 | 44.9 | — |
| P1 | P2-1 | 17.9 | 1:1 | 250 | $4.1 \times 10^{-2}$ | 420 | 57.1 | — |
| | | | | 500 | $3.8 \times 10^{-2}$ | 440 | 57.5 | — |
| P1 | P2-1 | 17.9 | 2:1 | 250 | $4.1 \times 10^{-2}$ | 420 | 58.1 | — |
| | | | | 500 | $4.5 \times 10^{-2}$ | 380 | 59.2 | 55.3 |
| P1 | P2-1 | 17.9 | 1:2 | 250 | $3.6 \times 10^{-2}$ | 480 | 53.5 | — |
| | | | | 500 | $3.95 \times 10^{-2}$ | 420 | 57.2 | 56 |
| P1 | P2-1 | 17.9 | 1:3 | 500 | $3.9 \times 10^{-2}$ | 420 | 55.1 | — |
| P1 | P2-2 | 27.2 | 1:1 | 250 | $3.5 \times 10^{-2}$ | 480 | 55.4 | — |
| P1 | P2-3 | 38.9 | 1:1 | 250 | $3.1 \times 10^{-2}$ | 540 | 54.8 | — |
| | | | | 500 | $3.8 \times 10^{-2}$ | 420 | 58.0 | — |
| P1 | P2-4 | 46.1 | 1:1 | 250 | $3.4 \times 10^{-2}$ | 540 | 53.2 | — |
| | | | | 500 | $4.2 \times 10^{-2}$ | 420 | 58.1 | — |
| P1 | P2-5 | 45.2 | 1:1 | 250 | $3.6 \times 10^{-2}$ | 420 | 55.6 | — |
| P1 | V2-2 | 0 | 1:1 | 500 | $2.8 \times 10^{-2}$ | 600 | 54.5 | — |
| — | V2-2 | 0 | — | 500 | $2.2 \times 10^{-2}$ | 660 | 43.5 | — |
| P1 | V2-1 | 0 | 1:1 | 500 | $3.6 \times 10^{-2}$ | 420 | 55.9 | — |

What is claimed is:

1. A method for solvent dewaxing a waxy hydrocarbon oil which comprises mixing the oil to be dewaxed with at least one solvent suitable for dewaxing and with a polymeric dewaxing aid comprising a polyacrylate, chilling the resulting mixture, whereby wax precipitates, and separating the precipitated wax, wherein said polymeric dewaxing aid is a mixture of (I) a first polymer of esters of acrylic acid with $C_{10}$–$C_{40}$ alkanols and (II) a second polymer of esters of methacrylic acid with alkanols comprising more than 15 percent by weight of branched alkanols, the weight ratio between components (I) and (II) ranging from 1:20 to 20:1.

2. A method as in claim 1 wherein the weight ratio between components (I) and (II) ranges from 1:10 to 10:1.

3. A method as claim 1 wherein said alkanols in said first polymer are $C_{18}$–$C_{24}$ alkanols.

4. A method as in claim 1 wherein said alkanols in said second polymer are $C_1$–$C_{40}$ alkanols.

5. A method as in claim 4 wherein said second polymer comprises at least 80 percent by weight of esters of methacrylic acid with $C_{10}$–$C_{24}$ alkanols.

6. A method as in claim 5 wherein said second polymer comprises not more than 20 percent by weight of esters of methacrylic acid with $C_1$–$C_9$ alkanols.

7. A method as in claim 4 wherein said alkanols in said second polymer are $C_1$–$C_{26}$ alkanols.

* * * * *